US009413089B2

(12) United States Patent
Miyazaki

(10) Patent No.: US 9,413,089 B2
(45) Date of Patent: Aug. 9, 2016

(54) CONNECTOR, AND HEADER AND SOCKET INCLUDED IN THE SAME

(71) Applicant: PANASONIC CORPORATION, Osaka (JP)

(72) Inventor: Yoji Miyazaki, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 13 days.

(21) Appl. No.: 14/303,354

(22) Filed: Jun. 12, 2014

(65) Prior Publication Data

US 2014/0377994 A1 Dec. 25, 2014

(30) Foreign Application Priority Data

Jun. 25, 2013 (JP) ..... 2013-132247

(51) Int. Cl.
*H01R 12/00* (2006.01)
*H01R 12/70* (2011.01)
*H01R 12/71* (2011.01)

(52) U.S. Cl.
CPC ..... *H01R 12/707* (2013.01); *H01R 12/716* (2013.01)

(58) Field of Classification Search
CPC ..... H01R 23/72; H01R 23/725; H01R 9/096; H01R 12/52
USPC ..... 439/44, 74
See application file for complete search history.

(56) References Cited

U.S. PATENT DOCUMENTS 8,845,339 B2 * 9/2014 Ono ..... H01R 12/7052 439/74
2009/0061655 A1 * 3/2009 Miyazaki ..... H01R 12/57 439/74

FOREIGN PATENT DOCUMENTS

JP 2005-019144 A 1/2005

* cited by examiner

*Primary Examiner* — Vanessa Girardi
(74) *Attorney, Agent, or Firm* — McDermott Will & Emery LLP

(57) ABSTRACT

A connector including a substantially rectangular housing made of an insulating material, a plurality of terminals which are provided for the housing and are attached to a circuit board to be electrically connected to the circuit board, and a holding bracket which is provided for the housing and is fixed on the circuit board. The holding bracket includes a first fixed terminal a fixed on the circuit board, and a second fixed terminal which is formed separately from the first fixed terminal a and is fixed on the circuit board.

8 Claims, 11 Drawing Sheets

55
61
61a(60a)
64a(64)
60(40)
55
54a(54)
20

64a(64)
39
52b
52a
50(40)
30
20
51
52b
51e
52
51e
31aA(31A)
31aA(31A)
56

54b(54)
62a
39
20
50(40)
51
60(40)
55

56
63
60(40)
63b(60a)
56a(54)
64a(64)
64b(64)
30
39
20
30
64b(64)

111
103a
102
102d
100
70
110
80
81c
81b
83
103
102a
102b
121a
121(120)
84
101

CONNECTOR, AND HEADER AND SOCKET INCLUDED IN THE SAME

CROSS REFERENCE TO RELATED APPLICATIONS

This application is based upon and claims the benefit of priority from prior Japanese Patent Application P2013-132247 filed on Jun. 25, 2013; the entire contents of which are incorporated by reference herein.

BACKGROUND OF THE INVENTION

The present invention relates to a connector, and a header and a socket which are included in the connector.

As shown in Japanese Patent Laid-open Publication No. 2005-019144 (hereinafter, referred to as Patent Literature 1), a conventionally-known connector includes: a socket having plural socket terminals on a socket body; and a header including plural header terminals on a header body.

In Patent Literature 1, the socket and header are fitted to each other to bring the socket terminals and header terminals into contact and conduction, thus electrically connecting conductor patterns of the circuit boards connected to the terminals.

SUMMARY OF THE INVENTION

However, in the aforementioned conventional technique, one each of fixed terminals of a holding bracket attached and fixed to the circuit board is provided at respective four corners of the housing. It is, therefore, difficult to increase the fixation strength of the connector on the circuit boards.

Accordingly, an object of the present invention is to provide a connector which can improve in strength of fixation on the circuit board, and a header and a socket which are included in the connector.

A first aspect of the present invention is a connector, including: a substantially rectangular housing made of an insulating material; a plurality of terminals which are provided for the housing and are attached to a circuit board to be electrically connected to the circuit board; and a holding bracket which is provided for the housing and is fixed on the circuit board, in which the holding bracket includes a first fixed terminal fixed on the circuit board, and a second fixed terminal which is formed separately from the first fixed terminal and is fixed on the circuit board.

A second aspect of the present invention is the connector, wherein the second fixed terminal is extended from the side plate portion of the holding bracket.

A third aspect of the present invention is the connector, wherein at least a part of the holding bracket is exposed along the housing.

A fourth aspect of the present invention is the connector, wherein the second fixed terminal is provided at a position where the distance from the first fixed terminal on the holding bracket is maximized.

A fifth aspect of the present invention is the connector, wherein the holding bracket is provided for the housing by insert molding.

A sixth aspect of the present invention is the connector, wherein the housing fills a part between a surface of the holding bracket exposed in an end face of the housing in the longitudinal direction and the surface thereof exposed in an end face thereof in the short-side direction.

A seventh aspect of the present invention is a socket included in the connector.

An eighth aspect of the present invention is a header included in the connector.

DETAILED DESCRIPTION OF THE PREFERRED EMBODIMENTS

Hereinafter, a description is given in detail of an embodiment of the present invention with reference to the drawings. In the following description, the width direction (the short-side direction) of a connector is referred to as a direction X; the longitudinal direction of the connector, a direction Y; and the top-bottom direction of the connector in FIG. 11, a direction Z. In the description of the socket and header, the upper sides of the socket and header in the state illustrated in FIG. 11 are referred to as an upper side (a front side) in the top-bottom direction, and the lower sides thereof are referred to as a lower side (a back side) in the top-bottom direction.

Figure 11:
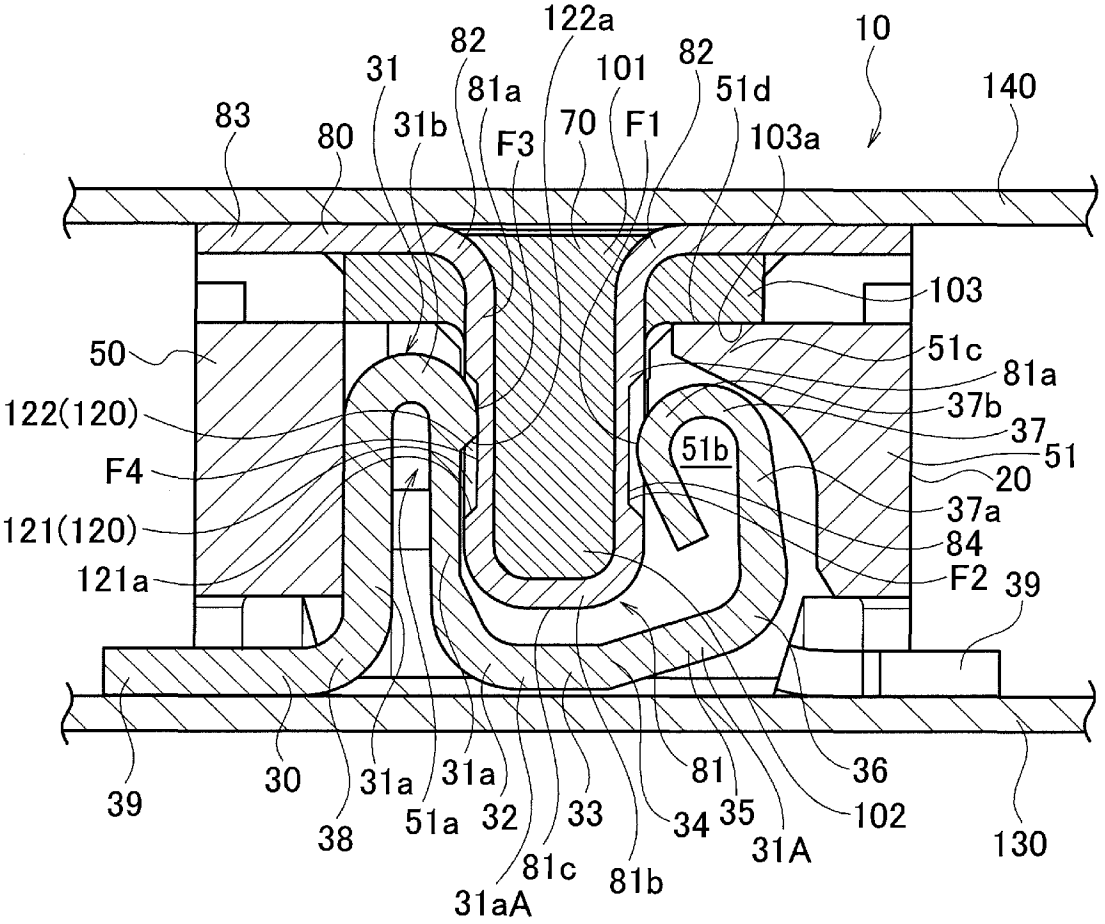
FIG. 11 is a cross-sectional view of the connector according to the embodiment of the present invention.

A connector 10 according to the embodiment includes a socket 20 and a header 70 fitted to each other as illustrated in FIG. 11. In the embodiment, the socket 20 includes a socket fitting body 40 which is provided with socket terminals 30, and the header 70 includes a header fitting body 90 provided with header terminals 80.

The socket fitting body 40 (a socket fitting portion of a later-described socket housing 50) and the header fitting body 90 (a header fitting portion of a later-described header housing 100) are fitted to each other to bring the socket terminals 30 and header terminals 80 into contact (see FIG. 11).

The socket 20 is attached to a first circuit board 130, and the header 70 is attached to a second circuit board 140.

When the socket 20 and header 70 are fitted to each other, therefore, the first circuit board 130 attached to the socket 20 is electrically connected to the second circuit board 140 attached to the header 70.

In the embodiment, as illustrated in FIGS. 1 to 3D, the socket fitting body 40 includes the socket housing 50 which is molded with insulating synthetic resin and has a rectangular (oblong) planar view. The socket fitting body 40 further includes socket holding brackets 60 provided at both ends of the socket housing 50 in the longitudinal direction Y.

The socket housing 50 is provided with the plural socket terminals 30 arranged at predetermined intervals in the longitudinal direction Y. In the embodiment, the plural socket terminals 30 are arranged in a single line in the longitudinal direction Y of the socket housing 50. In other words, a socket terminal group 30G including the plural socket terminals 30 arranged in the longitudinal direction Y of the socket housing 50 is provided only in a single line in the socket housing 50.

The socket terminal group 30G includes the plural socket terminals 30 arranged in such a manner that the socket terminals 30 with later-described socket main contacts 37 located on one side of the socket housing 50 in the width direction X and the socket main contacts 37 of the socket terminals 30 located on the other side are alternately located.

The socket housing 50 includes a plate-shaped wall portion 56 and a circumferential wall portion 51 continuously formed along the peripheral edge of the plate wall portion 56 and is formed in a substantially box shape open at one side (the upper side). Inside the circumferential wall portion 51, a fitting groove portion (a socket fitting portion) 52 for fitting of the header 70 is formed.

Furthermore, in the embodiment, tapered portions 51*e* are formed in the upper inside edge of the circumferential wall portion 51. Each of the tapered portions 51*e* inclines downward (toward the plate-shaped wall portion 56) toward the inside. The tapered portions 51*e* are formed on the short sides of the circumferential wall portion 51 and on both ends of each long side thereof in the longitudinal direction. The tapered portions 51*e* are also formed individually between the socket terminals 30 adjacent to each other and individually between the socket terminals 30 and the socket holding brackets 60. In this embodiment, the tapered portions 51*e* are formed on the substantially entire circumference of the circumferential wall portion 51.

The fitting groove portion (the socket fitting portion) 52 includes a narrow socket terminal group housing portion 52*a* which is formed at the center in the longitudinal direction Y and is provided with the socket terminal group 30G located so as to be exposed inside.

The fitting groove portion (socket fitting portion) 52 of the socket housing 50 includes socket wide portions 52*b* in the outside (the region corresponding to each header wide portion 102*b*) in the longitudinal direction Y, of the region (the socket terminal group housing portion 52*a*) where the socket terminal group 30G is provided. The socket wide portions 52*b* are wider than the region (the socket terminal group housing portion 52*a*) where the socket terminal group 30G is provided.

In the embodiment, the socket wide portions 52*b* are formed at both ends of the socket terminal group housing portion 52*a* in the longitudinal direction Y. The fitting groove portion (the socket fitting portion) 52 has a substantially I-shaped planar view with the socket terminal group housing portion 52*a* and the socket wide portions 52*b* at the both ends of the same.

The socket terminals 30 can be formed by bending a metallic belt material with a predetermined thickness, for example. In the embodiment, as illustrated in FIG. 11, each socket terminal 30 includes a U-shaped portion 31 including both sidewall portions 31*a*, 31*a* and a connecting portion 31*b* into an inverted U shape. At the end of one of the sidewall portions 31*a* (the right sidewall portion in FIG. 11) of the U-shaped portion 31, the socket terminal 30 is bent about a first bent portion 32 and is extended in the horizontal direction as a horizontal portion 33. At the end of the horizontal portion 33, the socket terminal 30 is bent upward about a second bent portion 34 as an inclined piece portion 35. At the end of the inclined piece portion 35, the socket terminal 30 is further bent upward about a third bent portion 36 and is bent toward the inside of the socket housing 50 (toward the center in the width direction) to form a socket main contact portion 37 having an inverted U-shape. In the embodiment, in other words, the socket main contact portion 37 (at least one of the socket and header terminals) includes a foot portion 37*a* standing upward from the third bent portion 36 and a contact 37*b* which is extended from the upper end of the foot portion 37*a* toward the inside of the socket housing 50 and comes into contact with an engagement recess portion (a header main contact portion) 84. The socket main contact portion 37 is configured to elastically deform about the third bent portion 36 with respect to the inclined piece portion 35.

In the embodiment, the inclined piece portion 35 is also configured to elastically deform about the second bent portion 34. Since the inclined piece portion 35 is configured to elastically deform as well as the socket main contact portion 37, the places where stress can be concentrated in the process of elastic deformation is increased in number, and the stress can be distributed. This can more reliably prevent the socket terminals 30 from wearing.

On the other hand, at the end of the other sidewall portion 31*a* (the left sidewall portion 31*a* in FIG. 11) of the U-shaped portion 31, the socket terminal 37 is bent about a fourth bent portion 38 and extended in the horizontal direction to form a flat socket connection terminal portion 39.

In the embodiment, as illustrated in FIGS. 1 to 3D and 11, the socket terminals 30 are attached to the socket housing 50 so that the socket main contact portions 37 may protrude into the fitting groove portion (socket fitting portion) 52. The U-shaped portions 31 and socket main contact portions 37 are, respectively, fitted into recess portions 51*a* and 51*b* formed on both sides of the circumferential wall portion 51 in the width direction. The recess portions 51*a* and 51*b* are alternately formed along the longitudinal direction Y in both sides of the circumferential wall portion 51 in the width direction.

With the U-shaped portions 31 and socket main contact portions 37 fitted in the recess portions 51*a* and 51*b*, respectively, the socket connection terminal portions 39 of the socket terminals 30 protrude outward in the width direction X from the foot (the lower edge) of the circumferential wall portion 51. The socket connection terminal portions 39 are connected to the conductor patterns (terminals) of the first circuit board 130 by soldering or the like. The socket terminals 30 are thus electrically connected to the first circuit board 130. In the embodiment, the socket connection terminal portions 39 are formed on the opposite side in the width direction X to the socket main contact portions 37 with respect to the U-shaped portions 31. The plural socket terminals 30 are arranged in the longitudinal direction Y side by side in such a manner that the socket terminals 30 with the socket main contact portions 37 located in one side in the width direction X of the socket housing 50 with respect to the U-shaped portions 31 and the socket terminals 30 with the socket main contact portions 37 located on the other side are alternately located. The socket connection terminal portions 39 therefore alternately protrude toward one side and toward the other side in the width direction X (see FIGS. 2 to 3D).

In such a manner, the socket terminal group 30G is formed so that the socket terminals 30 with the socket connection terminal portions 39 protruded on one side of the socket housing 50 in the width direction X and the socket terminals 30 with the socket connection terminal portions 39 protruded to the other side are alternately located in the embodiment.

In the assembly of the socket 20, the socket terminals 30 are inserted (press-fitted) from the back of the socket housing 50 (from the lower side in FIG. 11) to be attached to the socket housing 50 (socket fitting body 40).

When the socket terminals 30 are inserted (press-fitted) from the back (the lower side in FIG. 11) of the socket housing 50 in such a manner, the socket terminals 30 can be attached to the socket housing 50 (the socket fitting body 40) without interfering with later-described protrusion portions 51*c*.

In other words, even if the socket housing 50 includes the protrusion portions 51*c*, which can come into contact with protrusion portions 103 formed in a header housing 100, the socket terminals 30 can be attached to the socket housing 50 (the socket fitting body 40) by insertion (press-fitting).

Accordingly, it is possible to easily produce the socket 20 which can be prevented from rattling when the socket is fitted to the header 70.

As described above, in the embodiment, the recess portions 51*a*, to which the U-shaped portions 31 are fitted, and the recess portions 51*b*, to which the socket main contact portions 37 are fitted, are alternately formed in the longitudinal direction Y in both sides of the circumferential wall portion 51 in the width direction. In order to fit the U-shaped portions 31 into the respective recess portions 51*a* and the socket main contact portions 37 into the respective recess portions 51*b*, therefore, the plural socket terminals 30 are inserted into the socket housing 50 so that the socket terminals 30 adjacent to each other are reversed from each other by 180 degrees about the axis (a vertical axis passing through the center of the socket housing 50 in the width direction in FIG. 11) extending in the vertical direction (the direction Z).

In other words, the plural socket terminals 30 have the same shape and are attached from an end to the other end to the socket housing 50 (the socket fitting body 40) in the longitudinal direction (the direction Y) so as to be alternately reversed. Accordingly, the socket terminal 30 adjacent to the socket terminal 30 illustrated in FIG. 11 has a reversed shape so that the contact portion 37 may be in contact with the left side of the wall portion (the header fitting portion) 102, one of the sidewall portions 31*a* may be in contact with the right side of the wall portion (the header fitting portion) 102, and the socket connection terminal portion 39 may protrude rightward.

The socket terminals 30 may be attached to the socket housing 50 (the socket fitting body 40) by insert-molding or the like.

As described above, each socket main contact portion 37 having an inverted U-shape includes: the foot portion 37*a* standing upward from the third bent portion 36; and the contact 37*b* which is extended from the upper end of the foot portion 37*a* toward the inside of the socket housing 50 and comes into contact with an engagement recess portion (a header main contact portion) 84. The contact 37*b* has a shape extended from the upper end of the foot portion 37*a* toward the inside of the socket housing 50 as described above, so that the spring length of the socket main contact portion 37 is increased. Compared with the case where the upper end of the foot portion 37*a* is extended toward the outside of the socket housing 50, the increase in spring length makes more flexible the socket main contact portion 37, thus increasing the fitting reliability.

Furthermore, in the embodiment, the socket main contact portion 37 having an inverted U-shape is turned about the third bending portion 36 toward the inside of the socket housing 50 (the upper end of the foot portion 37*a* is located more inward than the lower end) so as to minimize the length of each socket terminal 30 in the width direction (the width in the direction X).

The above described shape of the socket terminals 30 allows the wall portion (header fitting portion) 102 to be fitted into the U-shaped portion 31A in the state where the wall portion 102 is lopsided toward one side (the sidewall portion 31*a* side) of the U-shaped portion 31A, which includes one of the sidewall portions 31*a* (the right sidewall portion 31*a* in FIG. 11), horizontal portion 33, inclined piece portion 35, and foot portion 37*a*. In other words, the center in the width direction (the direction X), of a lower connecting portion 31*a*A (the region between the first bent portion 32 and the third bent portion 36) of the U-shaped portion 31A, which includes the horizontal portion 33 and inclined piece portion 35, is located away from the center in the width direction (the direction X), of the wall portion (the header fitting portion) 102 on one side (the sidewall portion 31*a* side) in the width direction (the direction X).

Figure 1:
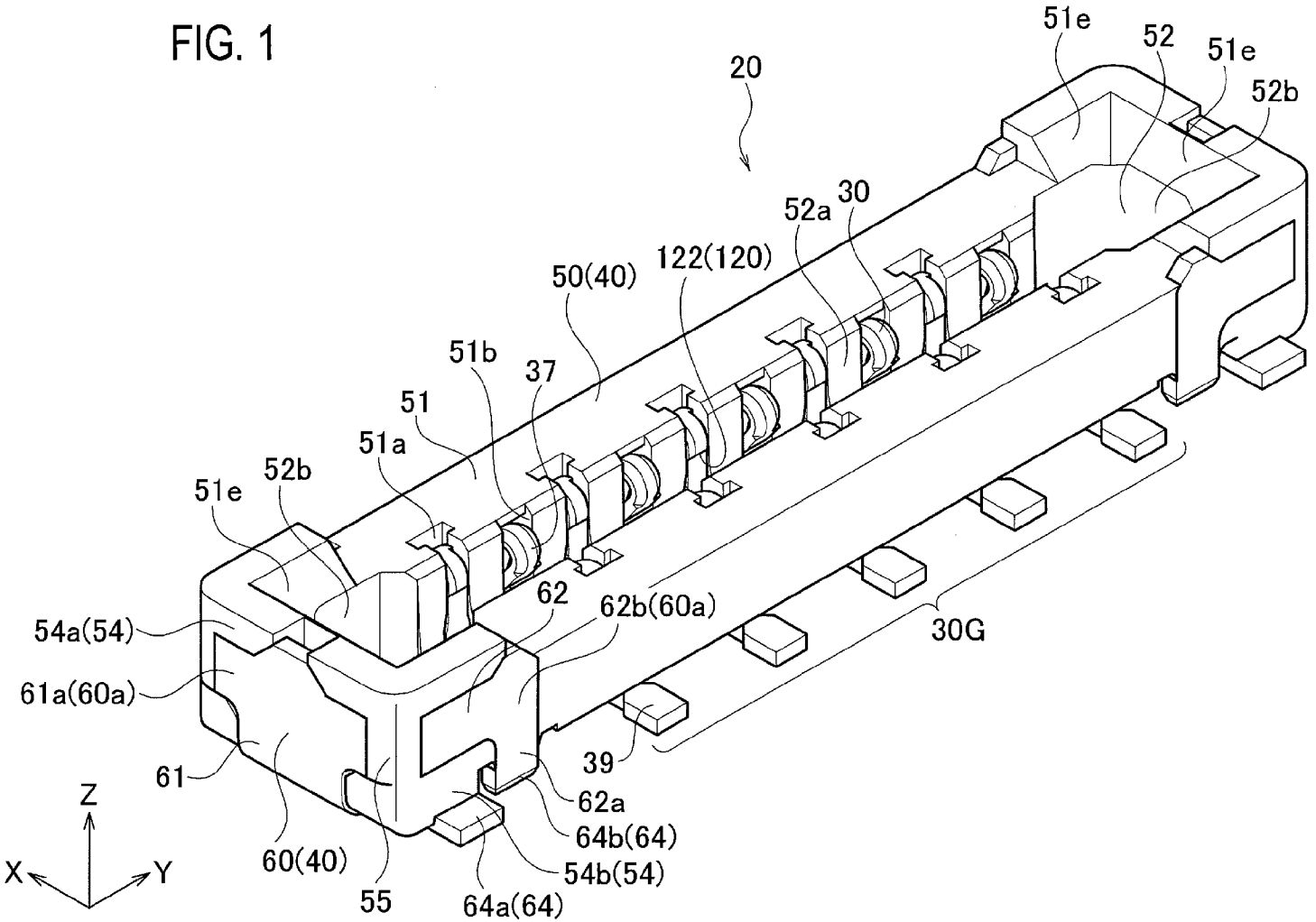
FIG. 1 is a perspective view of a socket of a connector according to an embodiment of the present invention seen from the front side.
Figure 2:
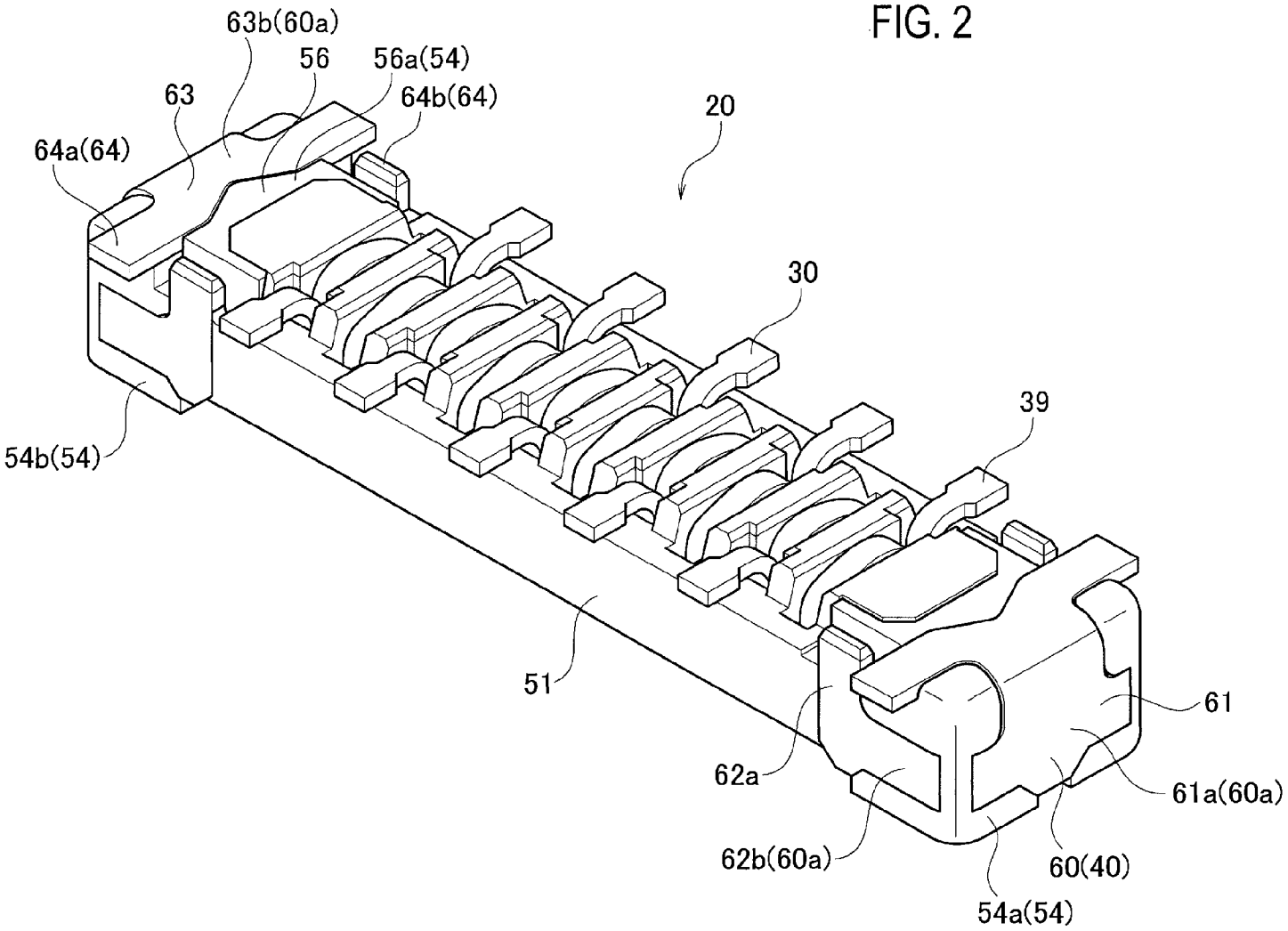
FIG. 2 is a perspective view of the socket of the connector according to the embodiment of the present invention seen from the back side.
Figures 3A, 3B, 3C, 3D:
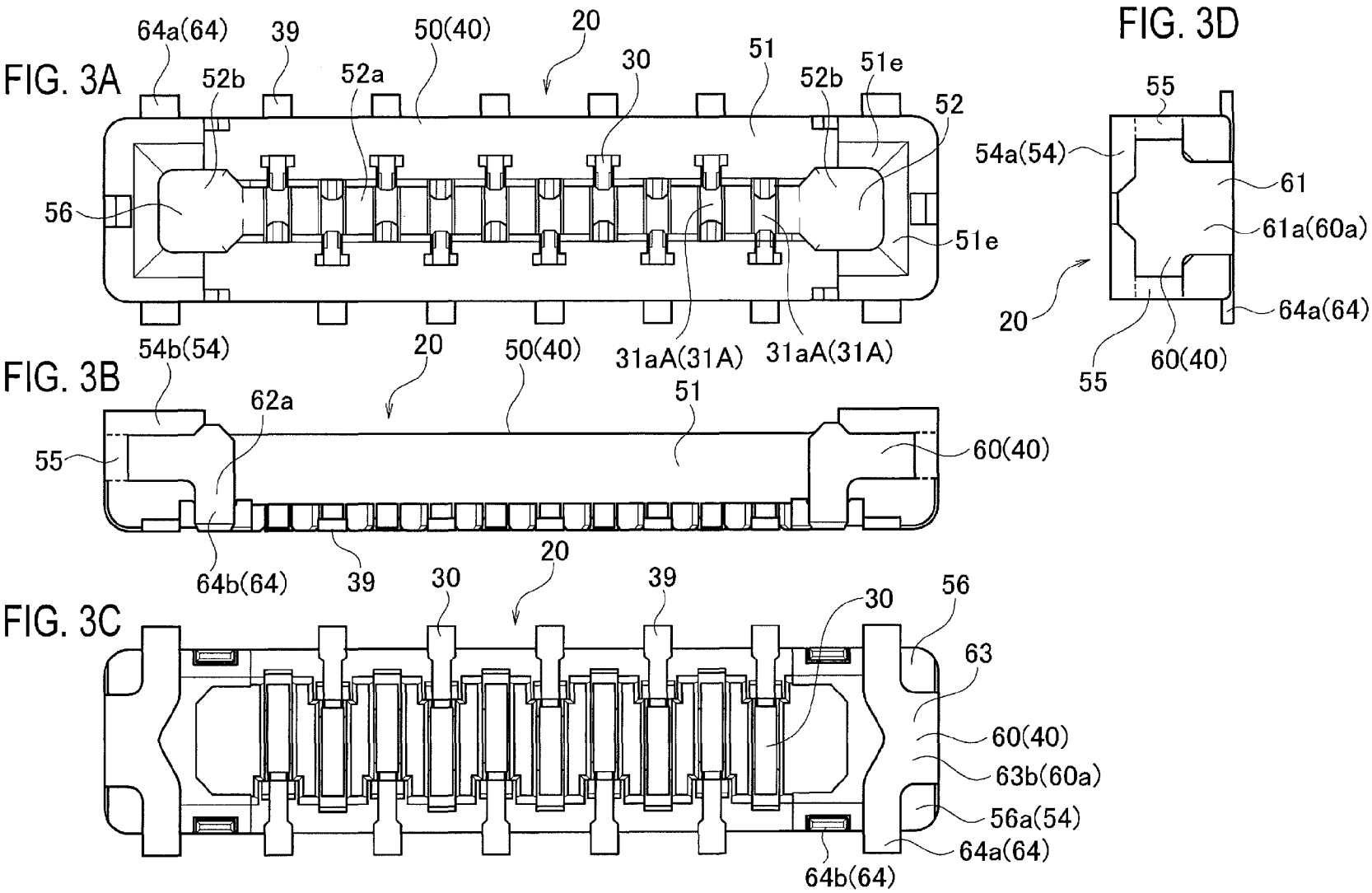
FIGS. 3A to 3D are views illustrating the socket of the connector according to the embodiment of the present invention, FIG. 3A being a planar view, FIG. 3B being a side view, FIG. 3C being a back view, and FIG. 3D being a front view.
Figure 4:
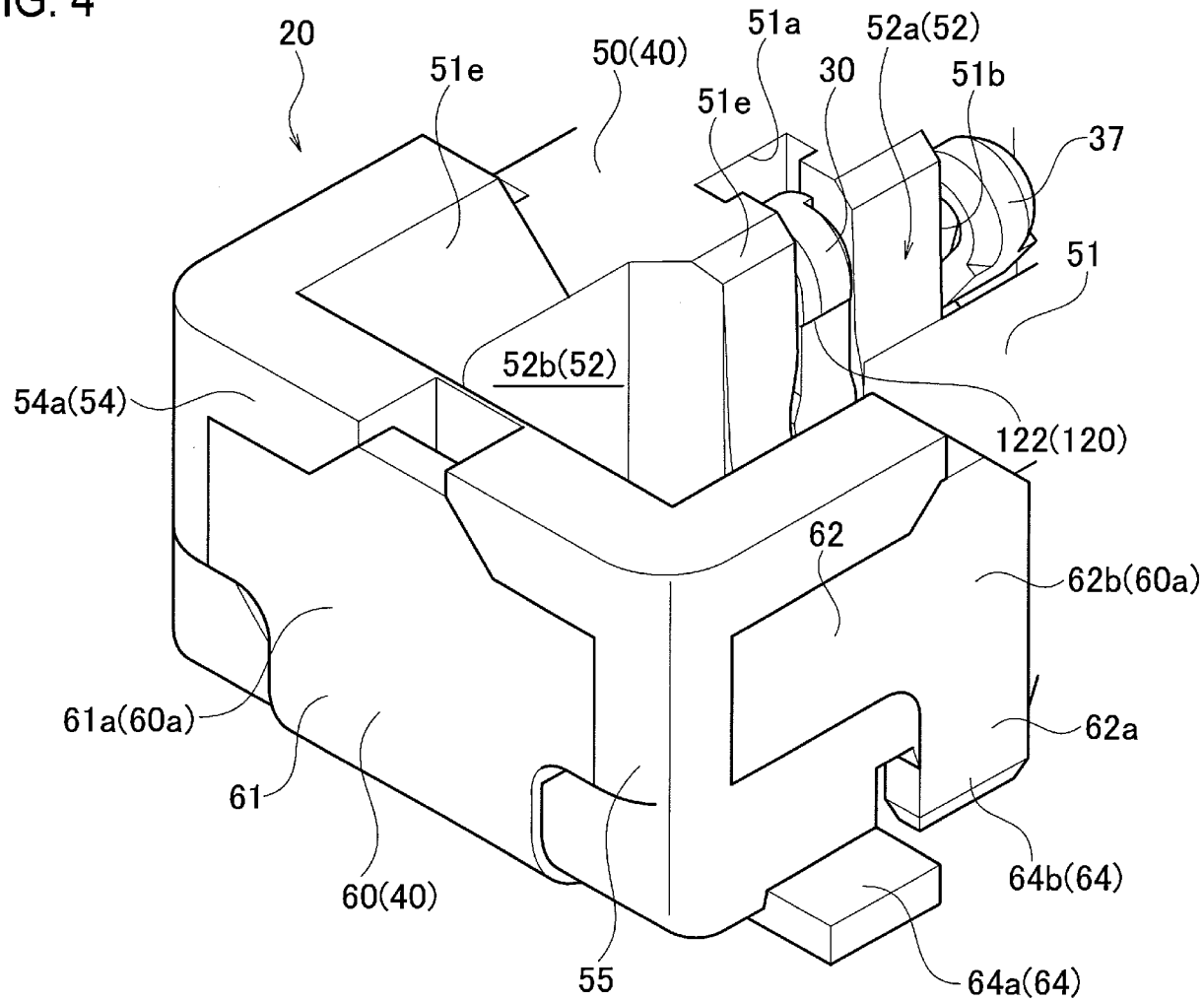
FIG. 4 is an enlarged perspective view of a part of the socket of the connector according to the embodiment of the present invention.
Figure 5A:
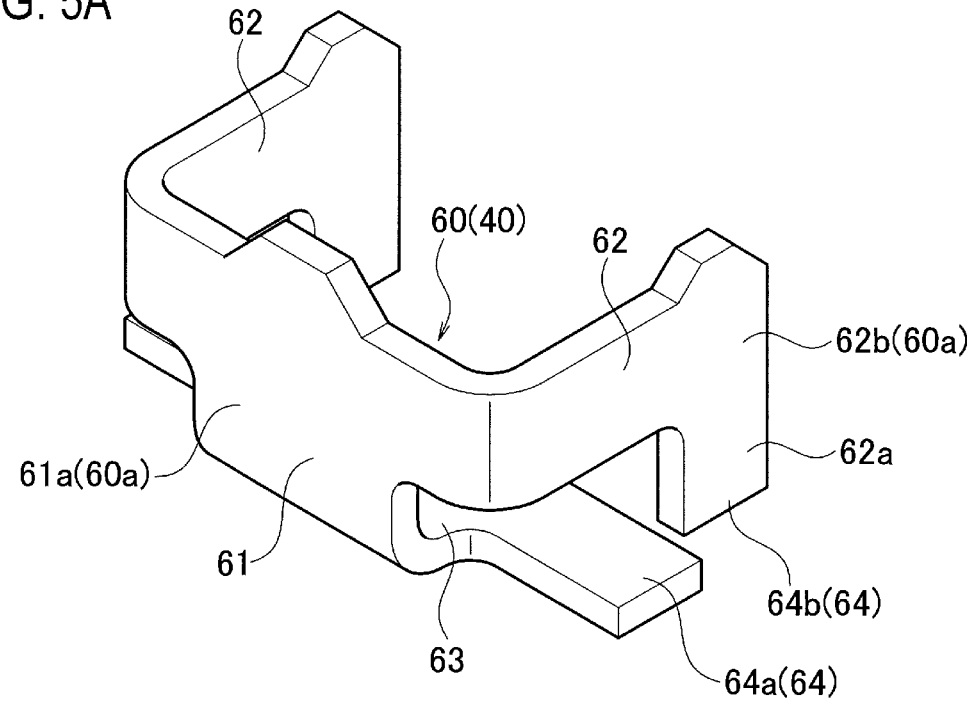
FIGS. 5A and 5B are perspective views of a socket holding bracket of the connector according to the embodiment of the present invention seen from the front side.
Figure 5B:
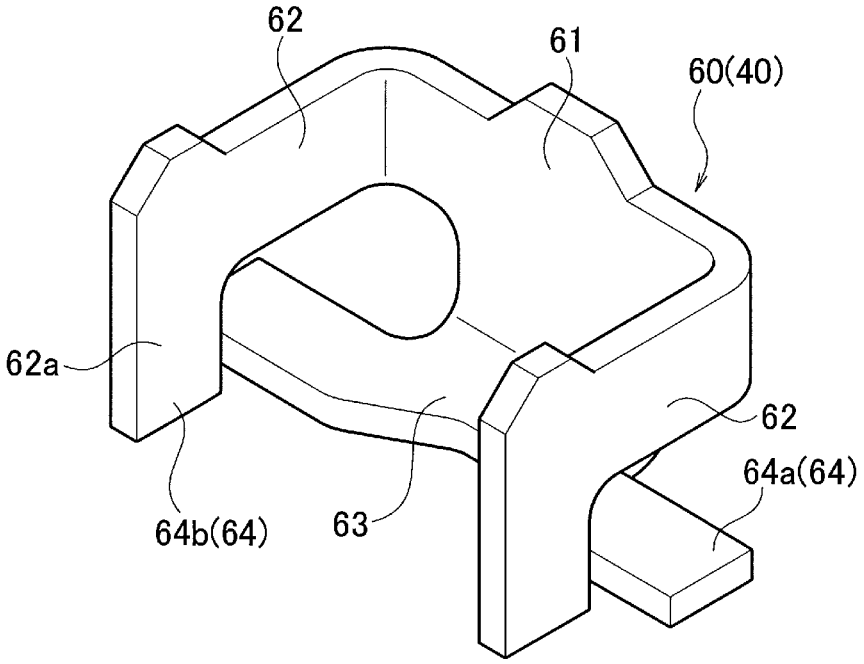
Figure 6A:
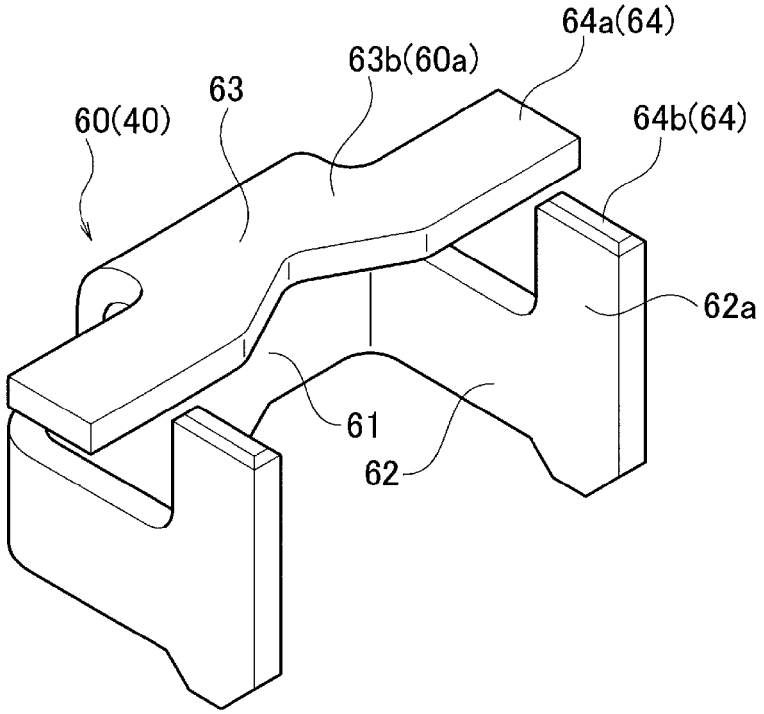
FIGS. 6A and 6B are perspective views of the socket holding bracket of the connector according to the embodiment of the present invention seen from the back side.
Figure 6B:
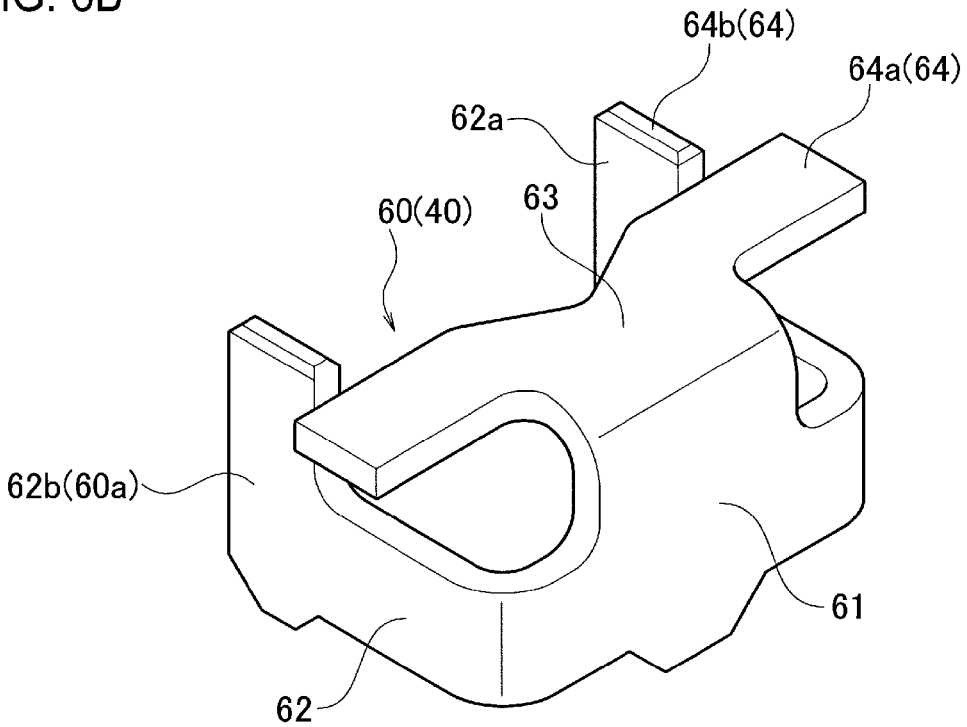

Accordingly, as illustrated in FIG. 3A, the socket terminals 30 adjacent to each other are arranged in the socket housing 50 so that the centers of the U-shaped portions 31A in the width direction (the direction X), more specifically, the centers in the width direction (the direction X), of the lower connecting portions 31*a*A (the regions between the first bent portions 32 and the corresponding third bent portions 36) are not aligned in the same line in the longitudinal direction (the direction Y) in the embodiment.

As illustrated in FIG. 3A, in every second one of the plural socket terminals 30, the centers of the U-shaped portions 31A in the width direction (the direction X) are aligned on the same line in the longitudinal direction (the direction Y).

To be more specific, the socket terminals 30 at the odd numbered positions from an end in the longitudinal direction (the direction Y) are arranged so that the centers of the U-shaped portions 31A in the width direction (the direction X) are aligned on the same line in the longitudinal direction (the direction Y). The socket terminals 30 at the even numbered positions from the same end in the longitudinal direction (the direction Y) are arranged so that the centers of the U-shaped portions 31A in the width direction (the direction X) are aligned on the same line in the longitudinal direction (the direction Y). The line extending in the longitudinal direction (the direction Y) through the centers of the U-shaped portions 31A of the socket terminals 30 located at the even numbered positions is offset in the width direction (the direction X) from the line extending in the longitudinal direction (the direction Y) through the centers of the U-shaped portions 31A of the socket terminals 30 located at the odd numbered positions.

On the other hand, as illustrated in FIGS. 8 to 10D, the header fitting body 90 includes the header housing 100, which is molded with insulating synthetic resin into a rectangular (oblong) as a whole in a planar view. The header fitting body 90 includes header holding brackets 110 provided at both ends of the header housing 100 in the longitudinal direction Y.

In the header housing 100, the plural header terminals 80 are arranged in the longitudinal direction Y at the same intervals (predetermined intervals) as those of the socket terminals 30. In the embodiment, the plural header terminals 80 are arranged in a single line in the longitudinal direction Y of the header housing 100. In other words, the header terminal group 80G including the plural header terminals 80 arranged in the longitudinal direction Y of the header housing 100 is provided in a single line in the header housing 100.

The header housing 100 includes: a plate-shaped wall portion 101; and a wall portion (a header fitting portion) 102 which protrudes downward in the center of the plate-shaped wall portion 101 and is fitted into the fitting groove portion (the socket fitting portion) 52. At the lower outside edge of the wall portion (the header fitting portion) 102, tapered portions 102*d* are formed so as to incline upward (toward the plate-shaped wall portion 101) toward the outside. The tapered portions 102*d* are formed at the short sides of the wall portion (the header fitting portion) 102 and at the both ends of each long side thereof in the longitudinal direction.

The wall portion (the header fitting portion) 102 includes a narrow header terminal group arrangement portion 102*a* which is formed at the center in the longitudinal direction Y and is provided with the header terminal group 80G.

The wall portion (the header fitting portion) 102 of the header housing 100 includes header wide portions 102*b* in the outside in the longitudinal direction Y, of the region (the header terminal group arrangement portion 102*a*) where the header terminal group 80G is provided. The header wide portions 102*b* are wider than the region (the header terminal group arrangement portion 102*a*) where the header terminal group 80G is provided.

In the embodiment, the header wide portions 102*b* are formed on both sides of the header terminal group arrangement portion 102*a* in the longitudinal direction Y. The wall portion (the header fitting portion) 102 has a substantially I-shaped planar view formed by the header terminal group arrangement portion 102*a* and the header wide portions 102*b* at both ends thereof.

Each header terminal 80 can also be formed by bending a metallic belt material with a predetermined thickness in a similar manner to the socket terminals 30. As illustrated in FIG. 11, each header terminal 80 includes a U-shaped portion 81 having both-sidewall portions 81*a* and 81*a* and a connecting portion 81*b* and has an inverted U-shape. The header terminal 80 further includes a flat portion 81*c* in the outer side of the connecting portion 81*b* (at the lower side in FIG. 11).

At the ends of both sidewall portions 81*a* of the U-shaped portion 81 are formed substantially flat header connection terminal portions 83. Each header connection terminal portion 83 is turned about a fourth bent portion 82 and is extended in the horizontal direction.

In such a manner, in the embodiment, each header terminal 80 includes the header connection terminal portions 83 which protrude toward the outside of the header housing 100 and is attached to the second circuit board 140. The header connection terminal portions 83 protrude from both sides of the header terminal 80 in the width direction X of the header housing 100.

Accordingly, the header terminal group 80G includes the header terminals 80 with the header connection terminal portions 83 protruding to one side in the width direction of the header housing 100 and the header terminals 80 with the header connection terminal portions 83 protruding to the other side.

The header terminals 80 are provided for the header housing 100 so that the U-shaped portions 81 may cover the top portion (the lower side in FIG. 11) of the wall portion (the header fitting portion) 102. The header terminals 80 are attached to the header housing 100 by insert molding. In this state, the header connection terminal portions 83 of each header terminal 80 are protruded outward in the direction X (the width direction) from the lower edge of the wall portion (the header fitting portion) 102 and are connected to conductor patterns (terminals) of the second circuit board 140 by soldering. The header terminals 80 are thus electrically connected to the second circuit board 140. The header terminals 80 may be press-fitted into the header housing 100 to be provided for the header housing 100 (the header fitting body 90).

As illustrated in FIG. 11, the header 70 is fitted to the socket 20 by inserting and fitting the wall portion (the header fitting portion) 102 of the header housing 100 into the fitting groove portion 52 of the socket housing 50. Accordingly, in the embodiment, one side (the upper side: the opening side) of the socket housing 50 corresponds to the side of the socket fitting body 40 which is fitted to the header fitting body 90, and the plate-shaped wall portion 56 is formed on the opposite side (the other side (the lower side) of the socket housing 50) to the side of the socket fitting body 40 which is fitted to the header fitting body 90. On the other hand, one side of the header housing 100 (the lower side: the protruding side) corresponds to the side of the header fitting body 90 which is fitted to the socket fitting body 40.

In the process of fitting the header 70 to the socket 20, for example, the tapered portions 51*e* and 102*d* formed on the long sides at one end in the direction X (the width direction: the short-side direction) are laid on each other and moved to the other end in the direction X (the width direction: short-side direction) for fitting. This allows the tapered portions 51*e* and 102*d* to function as a guiding portion, thus facilitating fitting of the header 70 and socket 20 to each other.

In the state where the header 70 is fitted to the socket 20, an outer surface F1 of the socket main contact portion 37 of each socket terminal 30 is in elastic contact with an outer surface F2 of one of the sidewall portions 81*a* of the corresponding header terminal 80. On the other hand, an outer surface F3 of the sidewall portion 31*a* of each socket terminal 30 is in elastic contact with an outer surface F4 of the other sidewall portion 81*a* of the header terminal 80. The socket terminal 30 and header terminal 80 are, therefore, electrically connected to each other, so that the conductor patterns of the first circuit board 130 are thus electrically connected to the conductor patterns of the second circuit board 140.

In the embodiment, the outer surface F2 of one of the sidewall portions 81*a* is the inner surface of the engagement recess portion (the header main contact portion) 84 which is formed in the sidewall portion 81*a* into a substantially V-shaped planar view. The outer surface F1 of the socket main contact portion 37 has a substantially trapezoidal shape with the width (the length in the longitudinal direction Y) narrowing toward the top (the outer surface F2) in a planar view. The inner surface (the outer surface F2) of the V-shaped engagement recess portion (the header main contact portion) 84 is in contact at two places with the outer surface F1 of the socket main contact portion 37, which is formed in a substantially trapezoidal shape.

Each socket main contact portion 37 is, therefore, in contact with the corresponding engagement recess portion (the header main contact portion) 84 at least two places in this embodiment.

Moreover, as described above, each socket terminal 30 and the corresponding header terminal 80, respectively, include at least one socket contact portion (the outer surface F3 of the sidewall portion 31*a*) and at least one header contact portion (the outer surface F4 of the sidewall portion 81*a*) which are in contact at a region other than the socket main contact portion 37 and engagement recess portion (header main contact portion) 84.

Furthermore, in the embodiment, the header housing 100 includes protrusion portions (abutment portions) 103 which are individually formed between the header connection terminal portions 83 and engagement recess portions (header main contact portions) 84 and are configured to abut on the socket housing 50 when the socket housing 50 is fitted to the header housing 100.

In the embodiment, the protrusion portions (the abutment portions) 103 each having a substantially cuboid shape extending in the longitudinal direction Y are formed on both sides of the U-shaped portions 81 in the width direction X. A lower surface 103*a* of each protrusion portion (abutment portion) 103 abuts on upper surfaces 51*d* of the protrusion portions 51*c* formed in respective regions where the recess portions 51*b* are formed in the circumferential wall portion 51 of the socket housing 50 when the socket housing 50 is fitted to the header housing 100.

The protrusion portions 51*c* are formed on both sides in the width direction X in a zigzag manner in the longitudinal direction Y in planar view. Accordingly, when the socket housing 50 is fitted to the header housing 100, the protrusion portions (the abutment portions) 103 formed on both sides of the U-shaped portions 81 in the width direction X are partially supported by the protrusion portions 51*c* formed in a zigzag manner.

The socket terminal 30 and header terminal 80 in the embodiment are provided with lock mechanisms 120 which are, respectively, engaged with the header and socket terminals 80 and 30 to keep the connection of the socket 20 and header 70.

To be specific, a first step portion (a header lock portion) 121 is formed in the outer surface (the surface on the side of the header terminal opposite to the side where the header contact portion is formed in the width direction of the header housing) F4 of each header terminal 80. On the other hand, a second step portion (a socket lock portion) 122 is formed in the outer surface (the surface on the side of the socket terminal opposite to the side where the socket main contact portion is formed in the width direction of the socket housing) F3 of each socket terminal 30. The first step portion (the header lock portion) 121 and the second step portion (the socket lock portion) 122 constitute one of the lock mechanisms 120. In other words, the first step portion (the header lock portion) 121 and the second step portion (the socket lock portion) 122 are engaged with each other to keep the connection of the socket 20 and the header 70.

In the embodiment, the first step portion 121, which includes an inclined step surface 121*a*, is formed by making thin a part of the header terminal 80 corresponding to the substantially central portion (in the vertical direction) of the surface of contact with the socket terminal 30 in the outer surface F4. On the other hand, the second step portion 122, which includes an inclined step surface 122*a*, is formed by making thin a part of the socket terminal 30 below the surface of contact with the header terminal 80 in the outer surface F3.

The engagement of the socket main contact portion 37 with the engagement recess portion (the header main contact portion) 84 also functions as a lock mechanism.

In the process of fitting the header 70 to the socket 20, the outer surfaces F2 and F4 of each header terminal 80 are inserted as pushing apart the outer surfaces F1 and F3 of the corresponding socket terminal 30 against the elastic force. The first step portion 121 then gets over the second step portion 122, and the socket main contact portion 37 of the socket terminal 30 is engaged with the engagement recess portion (the header main contact portion) 84, so that the header 70 is fitted and attached to the socket 20. In this process, the step surfaces 121*a* of the first step portions 121 are engaged with the step surfaces 122*a* of the second step portions 122 while the socket main contact portions 37 are engaged with the respective engagement recess portions (the header main contact portions) 84. The socket 20 and header 70 are, therefore, locked with each other to keep the connection therebetween.

On the other hand, in the process of detaching the socket 20 from the header 70, the socket 20 and header 70 are pulled off each other in the detachment direction. The step surface 121*a* of each first step portion 121 and the step surface 122*a* of the corresponding second step portion 122 then slide relatively to each other as pushing apart the outer surfaces of the socket terminal 30. The first and the second step portions 121 and 122 are thus disengaged from each other. In this process, the engagement recess portion (the header main contact portion) 84 is also disengaged from the socket main contact portion 37, thus allowing the socket 20 and header 70 to be separated from each other.

The engagement recess portions (the header main contact portions) 84 and the first step portions 121 are also alternately formed in the longitudinal direction Y on each side of the wall portion (the header fitting portion) 102 in the width direction.

In this embodiment, the plural header terminals 80 have the same shape and are mounted from an end to the other end on the header housing 100 (the header fitting body 90) in the longitudinal direction (the direction Y) so as to be alternately reversed. Accordingly, the header terminal 80 adjacent to the header terminal 80 illustrated in FIG. 11 has such a shape as reversed so that the engagement recess portion (the header main contact portion) 84 is located on the left side and the first step portion 121 is located on the right side. The header terminal 80 is line-symmetric with respect to the axis which extends in the vertical direction (the direction Z) through the center in the width direction (the direction X) other than the engagement recess portion (the header main contact portion) 84 and the first step portion 121. Accordingly, similarly in the header terminal 80 adjacent to the header terminal 80 illustrated in FIG. 11, the header connection terminal portions 83 and 83 protrude from both sides in the width direction X. The plural header terminals 80 are provided for the header housing 100 so that the centers of the U-shaped portions 81 in the width direction (the direction X) may be aligned on the same line in the longitudinal direction (the direction Y) (see FIG. 10A).

In the embodiment, as described above, the socket holding brackets 60 are provided at both ends of the socket housing 50 in the longitudinal direction Y, and the header holding brackets 110 are provided at both ends of the header housing 100 in the longitudinal direction Y. The socket and header holding brackets 60 and 110 are used to increase the strength of the socket and header housings 50 and 100 and to attach and fix the socket and header housings 50 and 100 to the aforementioned circuit boards.

In the embodiment, the fixed terminals 64 of the socket holding brackets 60 are soldered to the first circuit board 130. This allows the socket 20 to be firmly connected to the first circuit board 130 in cooperation with the socket connection terminal portions 39 of the socket terminals 30 soldered to the first circuit board 130.

Moreover, the fixed terminals 111 of the header holding brackets 110 are soldered to the second circuit board 140.

This allows the header 70 to be firmly connected to the second circuit board 140 in cooperation with the header connection terminal portions 83 of the header terminals 80 soldered to the second circuit board 140.

With such a configuration, the socket 20 and header 70 which are firmly connected to the respective circuit boards can be fitted to each other to bring the socket terminals 30 into contact and conduction with the respective header terminals 80. The conductor patterns of the circuit boards can be, therefore, electrically connected. Moreover, the socket terminals 30 and header terminals 80 are provided with the lock mechanisms 120 as described above. It is, therefore, possible to firmly keep the connection between the socket 20 and header 70.

Each socket holding bracket 60 can be formed by bending a holding bracket plate 60A which is formed by pressing a metallic plate with a predetermined thickness. The socket holding bracket 60 includes: a side plate portion 61 extending in the width direction X of the connector 10; and a bottom plate portion 63 which extends from the lower central part of the side plate portion 61 at a substantially right angle toward the center in the longitudinal direction Y. Both end portions of the bottom plate portion 63 are protruded outward from both sides of the connector 10 in the width direction X to form first fixed terminals 64*a*.

At both ends of the side plate portion 61 in the width direction X, extension portions 62 are formed. The extension portions 62 include both end portions of the side plate portion 61 bent at a substantially right angle toward the center of the connector 10 in the longitudinal direction Y. An extremity portion 62*a* of each extension portion 62 in the direction of extension includes a second fixed terminal 64*b* which is extended downward and is soldered to the first circuit board 130.

In the embodiment, four pairs in total of the first and second fixed terminals 64*a* and 64*b* located close to each other are provided at both ends (in the longitudinal direction Y) of the pair of long sides of the connector 10 so as to be arranged beside the corresponding socket terminals 30.

As described above, in the embodiment, each socket holding bracket (each holding bracket) 60 includes the first fixed terminals 64*a* fixed to the first circuit board (the circuit board) 130 and the second fixed terminals 64*b* which are formed separately from the first fixed terminals 64*a* and are fixed to the first circuit board (the circuit board) 130. The second fixed terminals 64*b* are extended from the side plate portion 61 of the socket holding bracket (holding bracket) 60.

Herein, each second fixed terminal 64*b* is provided at a position where the distance (the distance along an outer wall surface 60*a* of the socket holding bracket 60; the distance along the surface of the holding bracket) from the corresponding first fixed terminal 64*a* on the socket holding bracket (holding bracket) 60 is maximized.

Figure 7:
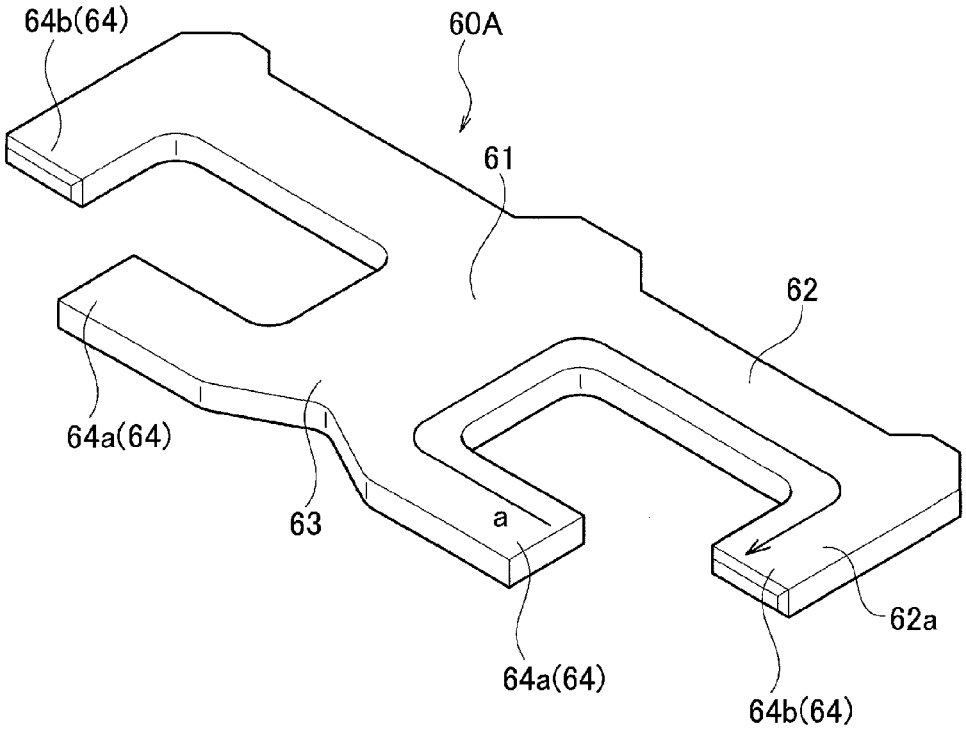
FIG. 7 is a perspective view of an unfolded state of the socket holding bracket of the connector according to the embodiment of the present invention.
Figure 8:
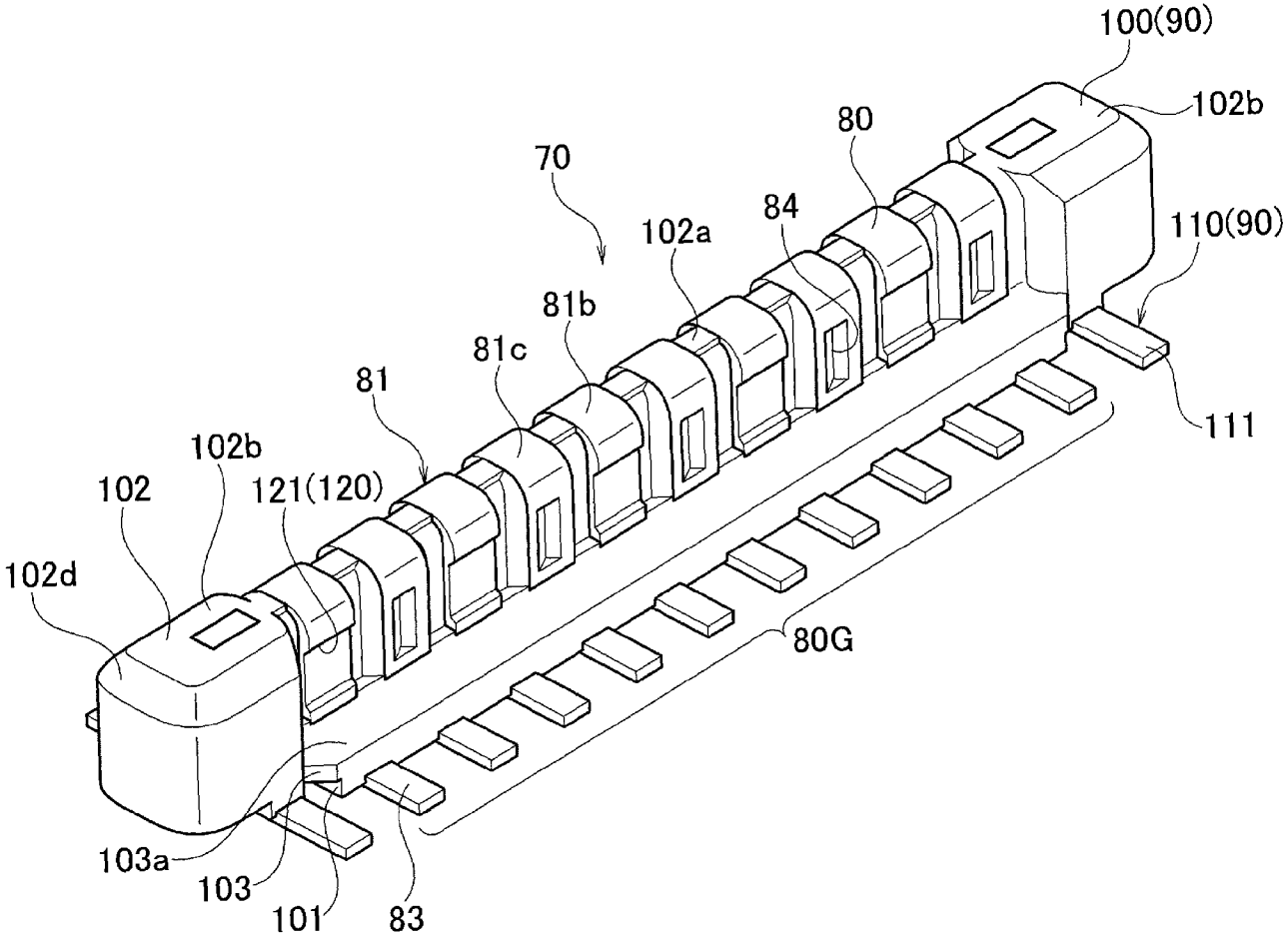
FIG. 8 is a perspective view of a header of the connector according to the embodiment of the present invention seen from the back side.
Figure 9:
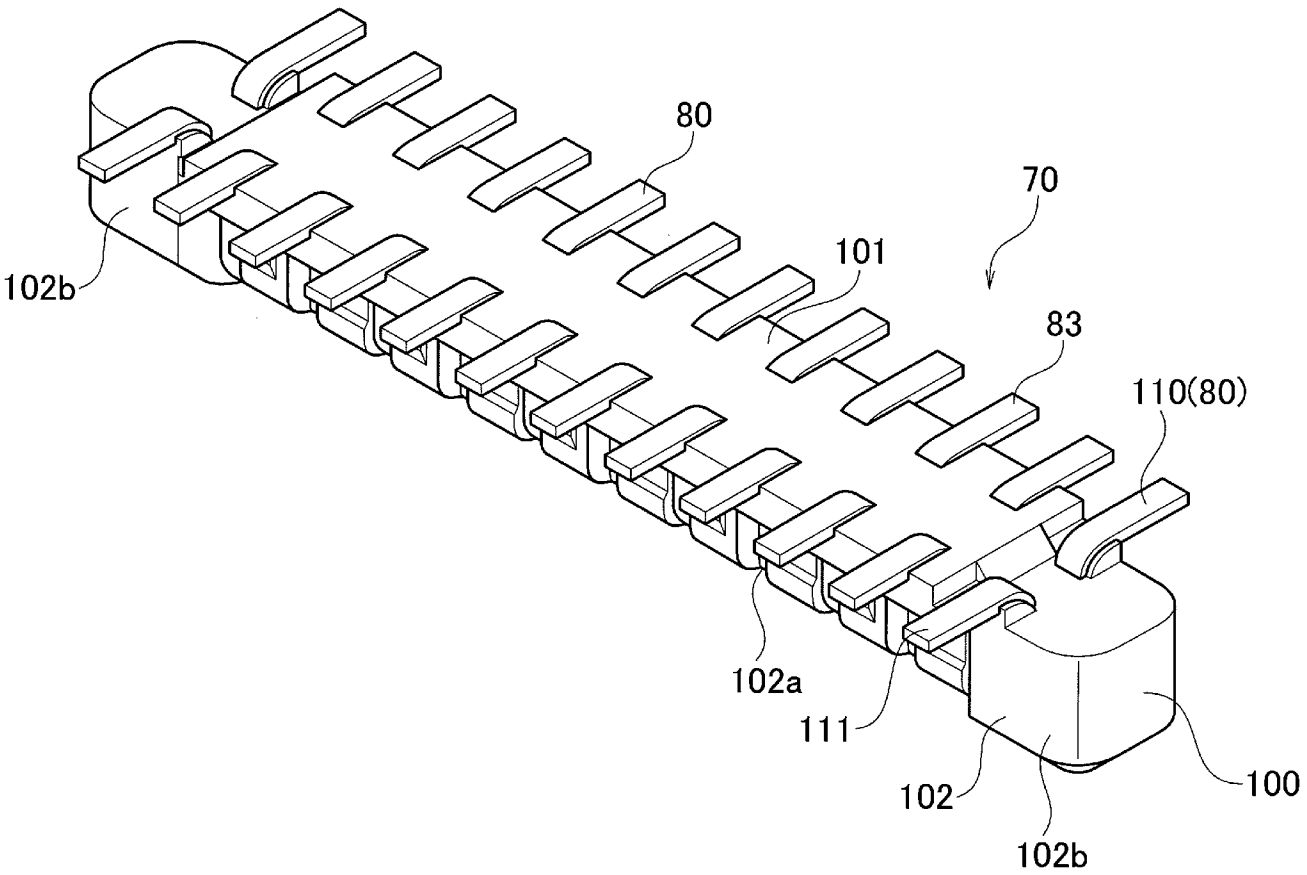
FIG. 9 is a perspective view of the header of the connector according to the embodiment of the present invention seen from the front side.
Figures 10A, 10B, 10C, 10D:
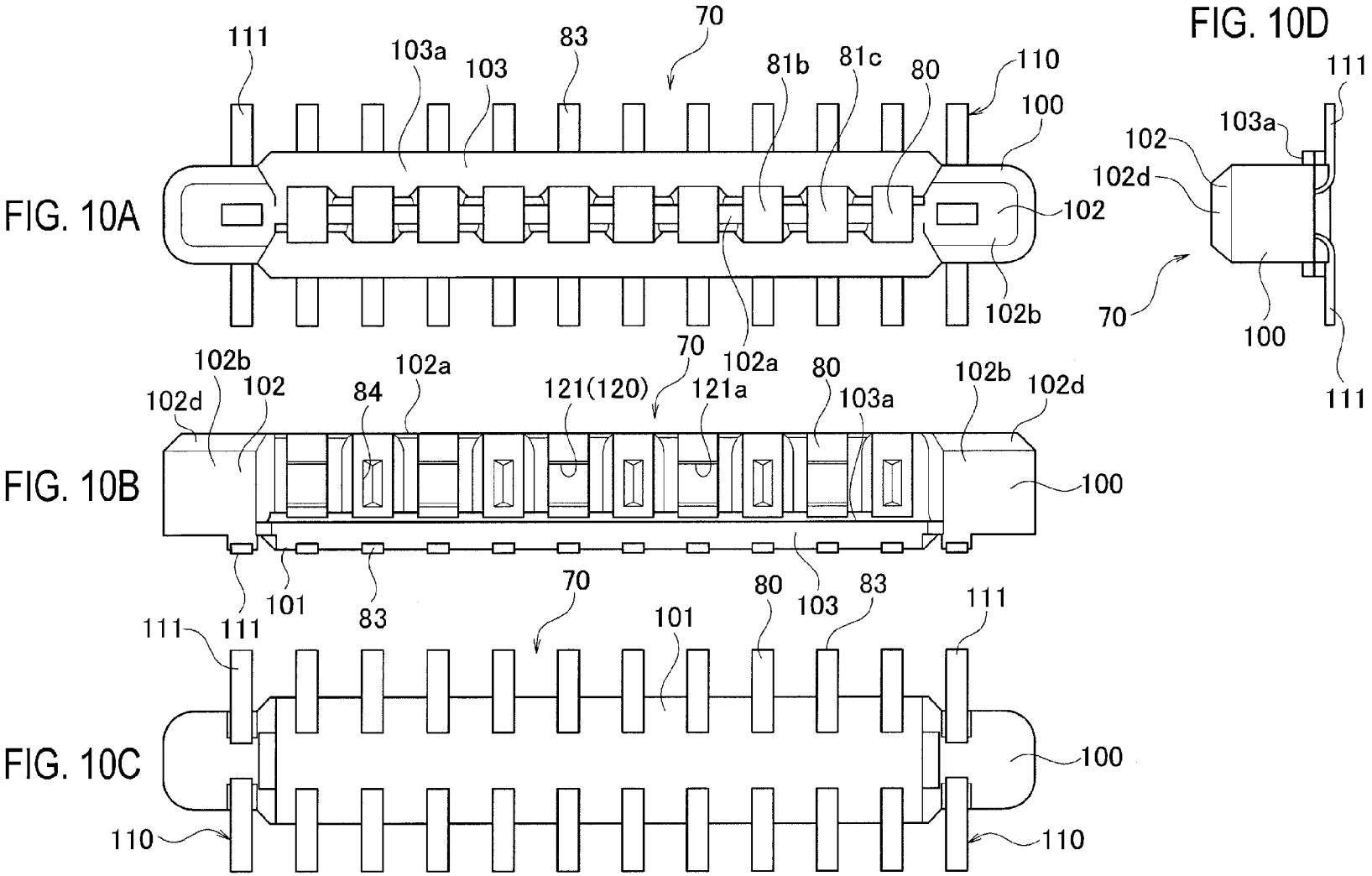
FIGS. 10A to 10D are views illustrating the header of the connector according to the embodiment of the present invention, FIG. 10A being a back view, FIG. 10B being a side view, FIG. 10C being a planar view, and FIG. 10D being a front view.

To be specific, the second fixed terminal 64*b* paired with each first fixed terminal 64*a* is formed at a position where the distance from the first fixed terminal 64*b* (the unfolded distance in the holding bracket plate 60A; the length of an arrow a of FIG. 7) is maximized when the socket holding bracket (the holding bracket) 60 is unfolded like a holding bracket plate 60A illustrated in FIG. 7.

In the embodiment, the socket holding brackets (the holding bracket) 60 are attached to (provided for) the socket housing (the housing) 50 by insert molding. Herein, at least a part of each socket holding bracket (holding bracket) 60 is exposed along the socket housing (the housing) 50.

In the embodiment, a part of an outer wall surface 54 of the circumferential wall portion 51 and plate-shaped wall portion 56 and apart of an outer wall surface 60*a* of the socket holding bracket 60 form a substantially same plane. In other words, the socket holding brackets 60 are integrally molded with the socket housing 50 so that a part of the outer wall surface 60*a* of each socket holding bracket 60 may be exposed at the substantially same plane as the outer wall surface 54 of the circumferential wall portion 51.

To be specific, upper part of the outside surface 61*a* of the side plate portion 61 is exposed in a state of being flush with the upper part of the outer surface (the end face in the longitudinal direction) 54*a* extending at the outermost end of the socket housing 50 in the direction Y (the longitudinal direction). An outside surface 62*b* of each extension portion 62 is exposed in a state of being flush with the outer surface (the end surface in the short-side direction) 54*b* extending at the outermost end in the direction X (the width direction; the short-side direction). An outside surface 63*b* of the bottom plate portion 63 is exposed on a different plane from the bottom surface 56*a* (the outer wall surface 54) of the socket housing 50 but can be exposed in a state of being flush with the bottom surface 56*a* (the outer wall surface 54) of the socket housing 50. Moreover, the outer wall surface 60*a* of each socket holding bracket 60 does not need to be exposed on the outer wall surface 54 of the circumferential wall portion 51. Even if the outer wall surface 60*a* is exposed, the outer wall surface 60*a* does not need to be exposed in a state of being flush with the outer wall surface 54 of the circumferential wall portion 51.

Furthermore, the socket housing (the housing) 50 fills the part between the surface (the outer surface 61*a* of the side plate portion 61) of the socket holding bracket (the holding bracket) 60 exposed in the end face of the socket housing (the housing) 50 in the longitudinal direction and the respective surfaces (the outer surfaces 62*b* of the extension portions 62) thereof exposed at the end faces in the short-side direction. In other words, connecting wall portions 55 are formed individually between the outer surface 61*a* of the side plate portion 61 and the outer surface 62*b* of each extension portion 62 thereof.

On the other hand, each header holding bracket 110 includes the same parts as the header terminals 80 and is provided in the outside (both sides in the embodiment) in the longitudinal direction Y, of the region where the header terminal group 80G is formed. Each header holding bracket 110 is positioned at the substantially same distance apart from the header terminal group 80G as the intervals of the header terminals 80.

In other words, the header terminals 80 located at both ends among the header terminals 80 arranged side by side at predetermined intervals in the longitudinal direction Y are used as the header holding brackets 110, and the plural header terminals 80 therebetween are used as the header terminal group 80G.

The header holding brackets 110 are insert-molded so that each contact portion (the U-shaped portion 81 of each header terminal 80) may be partially or completely embedded. In the embodiment, each header holding bracket 110 is insert-molded so that the part of the header holding bracket 110 corresponding to the flat portion 81*c* of the U-shaped portion 81 can be exposed. This can increase the strength of the header holding brackets 110. The header holding brackets 110 may be insert-molded so that the contact portions (the U-shaped portion 81 of the header terminals 80) thereof can be completely embedded.

Moreover, in the embodiment, the header 70 is formed to be symmetric with respect to the center of the socket 70 in a planar view, and the socket 20 is formed to be symmetric with respect to the center of the socket 20 in a planar view. Herein, the fitting groove portion (the socket fitting portion) 52 is formed to be symmetric with respect to the center of the fitting groove portion (the socket fitting portion) 52 in a planar view, and the wall portion (the header fitting portion) 102 is configured to be symmetric with respect to the center of the wall portion (the header fitting portion) 102 in a planar view. Accordingly, the center of the fitting groove portion (the socket fitting portion) 52 is located at the same position as the center of the socket 20, and the center of the wall portion (the header fitting portion) 102 is located at the same position as the center of the header 70.

As described above, the connector 10 of the embodiment includes the socket 20 and header 70 which are fitted to each other.

When the fitting groove portion (the socket fitting portion) 52 of the socket housing 50 is fitted onto the wall portion (the header fitting portion) 102 of the header housing 100, the socket terminals 30 and the header terminals 80 are brought into contact with each other.

Furthermore, the socket terminal group 30G including the plural socket terminals 30 arranged in the longitudinal direction Y of the socket housing 50 is provided only in a single line in the socket housing 50, and the header terminal group 80G including the plural header terminals 80 arranged in the longitudinal direction Y of the header housing 100 is provided only in a single line in the header housing 100.

By individually providing the socket terminal group 30G and the header terminal group 80G, which comes into contact with the socket terminal group 30G, only in a single line in the longitudinal direction Y, the socket housing 50 and header housing 100 can be reduced in width (the width in the direction X). In other words, the width (the width in the direction X) of the connector 10 can be reduced, thus increasing the freedom of arrangement of the connector 10 on the circuit boards (the first and second circuit boards 130 and 140).

Still furthermore, in the embodiment, each socket holding bracket (each holding bracket) 60 includes: the side plate portion 61 extending in the width direction X of the connector 10; and the bottom plate portion 63 which is bent from the lower center of the side plate portion 61 toward the center in the longitudinal direction Y at a substantially right angle. Each socket holding bracket (each holding bracket) 60 includes: the first fixed terminals 64*a* fixed onto the first circuit board (the circuit board) 130; and the second fixed terminals 64*b* which are separately formed from the first fixed terminals 64*a* and are fixed onto the first circuit board (the circuit board) 130.

Accordingly, it is possible to further increase the soldering strength of the socket 20 (the connector 10) onto the first circuit board (the circuit board) 130.

Still furthermore, in the embodiment, the second fixed terminals 64*b* are extended from the side plate portions 61 of each socket holding bracket (holding bracket) 60.

In other words, the socket 20 (the connector 10) is soldered to the first circuit board (the circuit board) 130 with the first fixed terminals 64*a* extended from the bottom plate portion 63 of each socket holding bracket (each holding bracket) 60 and the second fixed terminals 64*b* extended from the side plate portion 61. This can further increase the soldering strength of the socket 20 (the connector 10) to the first circuit board (the circuit board) 130 and also increase the strength of the sidewall of the socket 20 (the connector 10).

Herein, the second fixed terminal 64*b* is provided at a position where the distance from the first fixed terminal 64*a* is maximized on the socket holding bracket (holding bracket) 60.

To be specific, in the unfolded state of each socket holding bracket (each holding bracket) 60 like the holding bracket plate 60A, the second fixed terminal 64*b* paired with each first fixed terminal 64*a* is formed at a position where the distance from the first fixed terminal 64*a* is maximized (the unfolded distance on the holding bracket plate 60A).

Accordingly, the movement of each socket holding bracket (each holding bracket) 60 is restricted by the first and second fixed terminals 64*a* and 64*b*. This can further increase the strength of the socket holding brackets (the holding brackets) 60 and also increase the strength of the socket 20 (the connector 10).

Still furthermore, in the embodiment, the socket holding brackets (the holding brackets) 60 are attached to (provided for) the socket housing (the housing) 50 by insert molding. This can increase the molded wall thickness of the socket housing (the housing) 50 and increase the strength of the socket housing (the housing) 50.

Herein, at least a part of each socket holding bracket (each holding bracket) 60 is exposed along the socket housing (the housing) 50. To be specific, each socket holding bracket (each holding bracket) 60 is exposed at four sides, i.e., the bottom surface 56*a* and side surfaces 54*a*, 54*b*, and 54*b* on three sides in the socket housing (housing) 50. This can further increase the strength of the sidewall of the socket 20 (connector 10).

Still furthermore, in the embodiment, the socket housing 50 fills the part between the surface (the outside surface 61*a* of the side plate portion 61) of each socket holding bracket (each holding bracket) 60 which is exposed on the end face of the socket housing (the housing) 50 in the longitudinal direction and the surfaces (the outside surfaces 62*b* of the extension portions 62*b*) which are exposed in the end faces thereof in the short-side direction. This can prevent the socket holding brackets (the holding brackets) 60 from falling off the socket housing (the housing) 50.

Still furthermore, in the embodiment, each socket terminal 30 and the header terminal 80 corresponding thereto, respectively, include the socket and header main contact portions at least one of which is elastically deformable and which are brought into contact with each other.

The socket terminal group 30G is formed by arranging the plural socket terminals 30 in such a manner that the socket terminals 30 with the socket main contact portions 37 located on one side in the width direction X of the socket housing 50 and the socket terminals 30 with the socket main contact portions 37 located on the other side are alternately provided.

The aforementioned configuration of the socket terminal group 30G can prevent the socket main contact portions 37 from being located on one side in the width direction X or in the longitudinal direction Y when the socket 20 and header 70 are fitted to each other. Accordingly, the socket 20 and header 70 can be fitted in a balanced manner, or the socket main contact portions 37 and engagement recess portions (the header main contact portions) 84 can be brought into contact with each other in a balanced manner. This can further enhance the fitting retention of the socket 20 and header 70.

In the embodiment, especially, in the width direction X of the socket housing 50, the second step portions (the socket lock portions) 122, which are engaged with the first step portions (the header lock portions) 121, are formed on the side of the socket terminals 30 opposite to the region where the socket main contact portions 37 are formed. The socket main contact portions 37 and the second step portions (the socket lock portions) 122 are, therefore, alternately arranged in the longitudinal direction Y, so that the socket 20 and header 70 can be fitted to each other in a more balanced manner.

Still furthermore, in the embodiment, the fitting groove portion (the socket fitting portion) 52 of the socket housing 50 includes the socket wide portions 52*b*, which are wider than the region (the socket terminal group housing portion 52*a*) where the socket terminal group 30G is formed, in the outside (in the regions corresponding to the header wide portions 102*b*) in the longitudinal direction Y, of the region (the socket terminal group housing portion 52*a*) where the socket terminal group 30G is formed.

On the other hand, the wall portion (the header fitting portion) 102 of the header housing 100 includes the header wide portions 102*b*, which are wider than the region (the header terminal group housing portion 102*a*) where the header terminal group 80G is formed, in the outside in the longitudinal direction Y, of the region (the header terminal group housing portion 102*a*) where the header terminal group 80G is formed.

By providing the wide fitting portions in the outside in the longitudinal direction Y, of the region where the terminals are formed as described above, the header 70 can be prevented from being fitted in the incorrect position of the socket 20 deviated in the longitudinal direction Y.

In the embodiment, especially, the wall portion (the header fitting portion) 102 and the fitting groove portion (the socket fitting portion) 52 each have a substantially I-shaped planar view. This can more reliably prevent the socket 20 from being fitted to the incorrect position of the header 70.

Still furthermore, the header 70 is formed so as to be symmetric with respect to the center of the header 70 in a planar view. Accordingly, the header 70 rotated by 180 degrees can be fitted to the socket 20, thus improving the workability in assembling the header 70.

Still furthermore, in the embodiment, each socket terminal 30 and the header terminal 80 corresponding thereto, respectively, include at least one socket contact portion (the outer surface F3 of the sidewall portion 31*a*) and at least one header contact portion (the outer surface F4 of the sidewall portion 81*a*) which come into contact with each other at the places other than the socket main contact portion 37 and engagement recess portion (the header main contact portion) 84. This can increase the reliability in contact between the socket main contact portion 37 and engagement recess portion (the header main contact portion) 84, thus further enhancing the fitting retention of the socket 20 and header 70.

Still furthermore, in the embodiment, each socket main contact portion 37 and the engagement recess portion (the header main contact portion) 84 corresponding thereto are configured to come into contact with each other at at least two places. This further increases the reliability of contact between the socket main contact portion 37 and engagement recess portion (the header main contact portion) 84.

Still furthermore, in the embodiment, the socket terminal 30G is configured so that the socket terminals 30 with the socket connection terminal portions 39 protruding to one side of the socket housing 50 in the width direction X and the socket terminals 30 with the socket connection terminal portions protruding to the other side are alternately located. Accordingly, the socket connection terminal portions 39 alternately protrude on one side and on the other side in the width direction X. This prevents the positions of attachment of the socket connection terminals 39 to the first circuit board 130 from being located on one side in the width direction X or on one side in the longitudinal direction Y. Accordingly, the position of attachment of the socket 20 to the first circuit board 130 is well balanced, thus preventing the socket 20 from turning in the process of soldering. Moreover, it is possible to prevent the socket 20 from standing up due to the tombstone effect.

Still furthermore, in the embodiment, each header terminal 80 includes the U-shaped portion 81 which is provided with both sidewall portions 81*a*, 81*a* and the connecting portion 81*b* and is formed in an inverted U-shape. Accordingly, the shape of each header terminal 80 is substantially symmetric in the horizontal direction, so that the balance of the shape of the header 70 can be improved.

Still furthermore, the flat portion 81*c* is formed in the outer side of the connecting portion 81*b*. The flat portion 81*c* can be easily sucked by a machine such as a robot arm, and the header 70 can be, therefore, easily picked up by a machine or the like in the process of soldering the header 70 to the second circuit board 140 and in other processes. This can increase the soldering workability of the header 70 onto the second circuit board 140.

Still furthermore, in the embodiment, the header terminal group 80G includes the header terminals 80 with the header connection terminal portions 83 protruding toward one side of the header housing 100 in the width direction and the header terminals 80 with the header connection terminal portions 83 protruding toward the other side. To be specific, the header connection terminal portions 83, 83, respectively, protrude from both sides of the header terminals 80 in the width direction X of the header housing 100. This prevents the positions of attachment of the header connection terminals 83 on the second circuit board 140 from being located on one side in the width direction X or on one side in the longitudinal direction Y, thus improving the balance of the position of attachment of the header 70 to the second circuit board 140 and preventing the header 70 from turning in the soldering process. Moreover, it is possible to prevent the header 70 from standing up due to the tombstone effect. Furthermore, it is possible to further increase the soldering strength of the header 70 onto the second circuit board 140 and increase the current capacity.

Still furthermore, in the embodiment, each header holding bracket 110 includes the same parts as the header terminals 80 and is located at the substantially same distance as the intervals of the header terminals 80 from the header terminal group 80G in the outside in the longitudinal direction Y (on both sides in the embodiment), of the region where the header terminal group 80G is formed. Accordingly, the parts can be shared, and the cost can be reduced. Moreover, the header 70 can be more easily manufactured.

Still furthermore, in the embodiment, the header housing 100 includes the protrusion portions (the abutment portions) 103 which are formed between the header connection terminal portions 83 and the engagement recess portions (the header main contact portions) 84 and abut on the socket housing 50 when the socket housing 50 and header housing 100 are fitted to each other. This can prevent the socket 20 and header 70 fitted to each other from wobbling.

As described above, according to the embodiment, it is possible to provide the connector 10, which can improve in strength of fixation on the circuit board 130, and the socket 20 and header 70 included in the connector 10.

Hereinabove, the preferred embodiment of the present invention is described. However, the present invention is not limited to the aforementioned embodiment and can be variously modified.

For example, the specifications (the shapes, sizes, layouts, and the like) of the socket terminals, header terminals, and the other components can be properly changed.

What is claimed is:

1. A connector, comprising:

a substantially rectangular housing made of an insulating material;

a plurality of terminals which are provided for the housing and are attached to a circuit board to be electrically connected to the circuit board; and a holding bracket which is provided for the housing and is fixed on the circuit board, wherein the holding bracket includes a first fixed terminal fixed on the circuit board, and a second fixed terminal which is formed separately from the first fixed terminal and is fixed on the circuit board at a position more inwardly than the first fixed terminal in the longitudinal direction of the housing and the second fixed terminal is located at a position more inwardly than the first fixed terminal in the width direction of the housing.

2. The connector according to claim 1, wherein the second fixed terminal is extended from a side plate portion of the holding bracket.

3. The connector according to claim 1, wherein at least a part of the holding bracket is exposed along the housing.

4. The connector according to claim 1, wherein the second fixed terminal is provided at a position where the distance from the first fixed terminal on the holding bracket is maximized.

5. The connector according to claim 1, wherein the holding bracket is provided for the housing by insert molding.

6. The connector according to claim 1, wherein the housing fills a part between a surface of the holding bracket exposed in an end face of the housing in the longitudinal direction and the surface thereof exposed in an end face thereof in the short-side direction.

7. A socket included in the connector according to claim 1.

8. A header included in the connector according to claim 1.

* * * * *